United States Patent [19]

Baboian et al.

[11] 4,069,110

[45] Jan. 17, 1978

[54] TREATMENT OF BERYLLIUM COPPER SURFACE PRIOR TO ELECTROPLATING

[75] Inventors: Robert Baboian, Johnston, R.I.; Gardner S. Haynes, Attleboro, Mass.

[73] Assignee: Texas Instruments Incorporated, Dallas, Tex.

[21] Appl. No.: 658,320

[22] Filed: Feb. 17, 1976

[51] Int. Cl.[2] ..... C25D 7/00; C25D 5/34

[52] U.S. Cl. ..... 204/29; 134/41; 156/656; 156/664; 204/28; 204/32 R; 204/141.5; 204/146

[58] Field of Search ..... 427/307, 309; 204/29, 204/28, 32 R, 141.5, 146, 129.35; 134/3, 26, 28, 29, 38–41; 252/79.2; 156/7, 18, 20, 656, 664

[56] References Cited

U.S. PATENT DOCUMENTS

| | | | |
|---|---|---|---|
| 2,504,906 | 4/1950 | Tremblay | 204/32 R |
| 3,189,532 | 6/1965 | Chow et al. | 204/28 |
| 3,853,717 | 12/1974 | Diguilio | 204/28 |

*Primary Examiner*—William A. Powell
*Attorney, Agent, or Firm*—John A. Haug; James P. McAndrews

[57] ABSTRACT

A process for the surface treatment of beryllium copper prior to electroplating comprising degreasing the material, removing beryllium from the surface thereby leaving a copper-rich surface and activating the copper-rich surface for electroplating. The removal of the beryllium is accomplished by causing the beryllium to form compounds and then dissolving the compounds without dissolving the copper.

10 Claims, 1 Drawing Figure

TREATMENT OF BERYLLIUM COPPER SURFACE PRIOR TO ELECTROPLATING

BACKGROUND AND SUMMARY OF INVENTION

Figure 1:
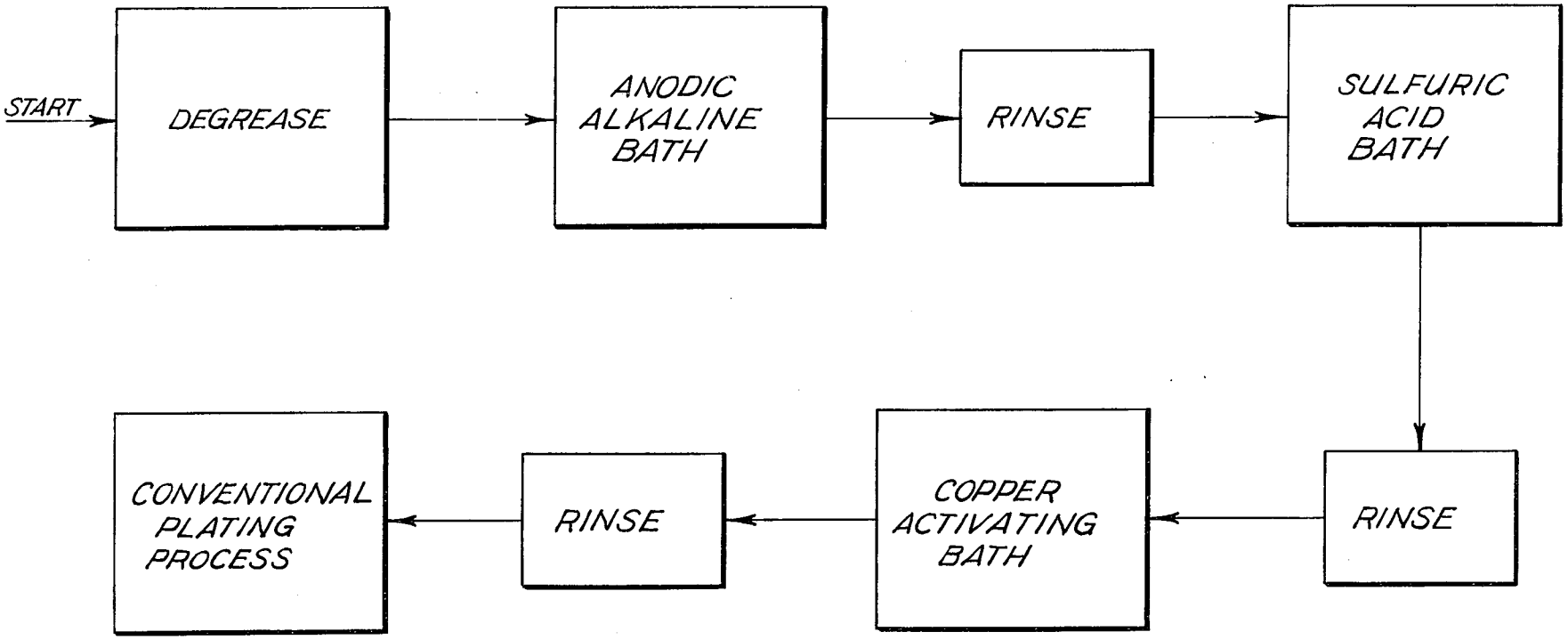

The present invention relates to a treatment of a copper alloy surface and more particularly to the treatment of a beryllium copper surface prior to electroplating.

Various systems for treating beryllium copper prior to electroplating exist in the prior art. These systems basically involve attacking the copper and the beryllium on the surface thus leaving a new surface essentially similar to the initial beryllium copper surface but clean (i.e. free from contaminants, impurities, and some beryllium compounds). However, due to the tenacity of beryllium compounds and the instantaneous formation of new ones these systems provide less than satisfactory results in many cases resulting in poor adhesion of plate in certain areas on the plated surface. Often some beryllium compounds are left on the surface after the preplating treatment and these areas where the beryllium compound exists result in places which cannot be properly activated for plating. This entire plating problem of the beryllium is increased when a continuous automated strip treatment and plating process is desired. Typically prior art processes for the treatment of the beryllium copper prior to electroplating require too long a time in solution to reasonably provide for a continuous strip operation.

There has thus been an unfulfilled need in the art for a reliable practical means for treating beryllium copper prior to plating, particularly means which provides for a continuous automatic strip process.

Accordingly an object of the present invention is to provide an improved process for treating a beryllium copper surface.

Another object of the present invention is to provide a process for treating beryllium copper material prior to electroplating which allows for uniform consistent void-free plating.

Yet another object of the present invention is to provide a process for treating a continuous strip of beryllium copper prior to electroplating which is simple and economical and creates a uniform void-free plated surface. Other objects and features will be in part apparent and in part pointed out hereinafter.

Briefly, the present invention involves a process for the treatment of beryllium copper prior to electroplating comprising the steps of degreasing the material, removing the beryllium from the surface thereby leaving a copper rich area and activating the copper rich surface area for plating. A vapor degreaser is preferably used to remove greases and oils from the material. Then an alkaline solution having a high solubility for beryllium is used along with anodic electrolysis in order to form beryllium compounds both directly on the surface and in material layers directly below the surface. Next the beryllium compounds are dissolved in a sulfuric acid bath thus leaving a copper rich portion on and near the surface. Finally the copper enriched portion is put through a copper activating bath to reduce any copper compounds formed in order to prepare the material for plating.

Referring to the drawings:

The FIGURE is a block diagram illustration of the process for treating beryllium copper prior to electroplating.

The present invention is thus directed to a process for treating the surface area of beryllium copper prior to electroplating. As shown in FIG. 1 the beryllium copper is first passed through a degreasing operation preferably a vapor degrease to remove any oil, grease, or other organic substances from the surface of the beryllium copper. Typically the vapor degrease operation provides for passing the material through a tank of chlorinated hydrocarbon vapors (i.e. trichloroethylene) at a temperature in the range of 175° F.

The material is then run through an alkaline solution having a high solubility for beryllium compounds and is subjected to anodic electrolysis in order to form the certain desired beryllium compounds. In this step the beryllium in the beryllium copper forms compounds such as oxides of beryllium both on the surface and in the molecular portions immediately adjacent the surface of the beryllium copper. A typical depth of compound formation would be 100 angstroms as has been verified by Auger microspectroscopy. Hereinafter when the surface is referred to it will include the area directly below the immediate surface also. Preferably an alkali metal hydroxide solution is used such as potassium hydroxide (KOH) although other alkali metal hydroxide solutions like sodium hydroxide (NAOH) and lithium hydroxide (LiOH) can also be used. Good results were obtained with the use of concentrated alkali of potassium in deionized water with the concentration between 30 and 40 percent KOH although concentrations from 10 to 50 percent KOH can be used. A suitable cathode for use in the solution is one made from 304 stainless steel or nickel. The temperature of the solution can be between 130° and 200° F with the preferred range between 150° and 190° F. The current density for the anodic electrolysis is preferably above 50 amperes/foot$^2$ with a typical value of 150 amperes/foot$^2$. A typical dwell time in the solution is 30 seconds with a range from 5 to 50 seconds.

The beryllium copper preferably is rinsed in deionized water prior to going on to the third step. The third step is a concentrated sulfuric acid soak which dissolves the formed beryllium compounds on the surface and in the molecular portions immediately adjacent the surface but does not touch the copper which leaves a copper-rich surface area which is virtually free of beryllium. The concentration of the sulfuric acid is preferably above 50 percent although concentrations down to 20 percent are functional. The temperature of the sulfuric bath should be in the 130° to 170° F range with a dwell time in the tank of at least 10 seconds although a 30 second dwell time is preferred.

Once again the beryllium copper is preferably rinsed in deionized water before going on to step number four. The fourth step involves the use of a copper activating bath to reduce copper compounds such as oxides from the copper-rich surface prior to plating. A preferable bath would be a cathodic bath of sulfuric acid although other suitable copper activating baths could be used such as a potassium cyanide or a sodium cyanide bath. The concentration of the sulfuric acid is preferably 20 to 30 percent although a range of 5 to 50 percent can be used and the temperature can be in the range of 125° to 175° F. A suitable anode for the cathodic treatment is a platinum type anode such as a platinum clad columbium anode. The current density in the bath is preferably about 100 amperes/foot$^2$ with an effective range of between 50 and 200 amperes/foot$^2$. The dwell time in the bath should be a minimum of 5 seconds with a typical dwell time of 15 seconds. The copper activating step four is followed by a deionized water rinse. If desired, where the fourth step noted above is performed with a sulfuric and cathodic bath as suggested above, the previously noted third step can be performed as part of the fourth step, the dwell time of the material in the bath and the bath temperature being selected to allow full dissolution of beryllium compounds from the desired surface layer of the material and to provide an activated surface suitable for plating.

The beryllium copper material now has a compound free copper-rich surface and is ready for plating by any conventional means. The plating material may be copper, nickel, silver, gold or alloys of them or other suitable metals and alloys. The dwell time at the various steps of the beryllium copper treatment process are such that an automated continuous operation is contemplated which can be the first part of a subsequent continuous plating line. Thus the process allows for an efficient high speed operation which is very cost effective. Very often the beryllium copper will be preformed into parts carried on the beryllium copper strips and then passed through the preplating treatment and the subsequent plating.

The practice of the invention may be further illustrated by means of the following examples:

EXAMPLE 1

A continuous strip of beryllium copper having 1.8 weight percent beryllium and the balance copper was passed through a vapor degreaser. The material was next passed through an anodic bath of 30 percent potassium hydroxide with a temperature of 175° F. A cathode of 304 stainless steel was used and the current density was 150 amperes/foot$^2$. The dwell time in the bath was 30 seconds. The strip was then rinsed in deionized water and passed through a 70 percent sulfuric acid solution with a temperature of about 150° F and a dwell time of about 30 seconds. The material was rinsed again in deionized water and held in a cathodic bath of sulfuric acid with a 20 percent concentration operated at a temperature of about 150° F. An anode of platinum clad columbium was used with a cathodic current density of 100 amperes/foot$^2$. The dwell time in the bath was 15 seconds. The strip was rinsed in deionized water and then plated in any conventional manner with any number of possible metals and alloys such as nickel, copper or gold yielding the desired uniform void-free plated surface.

EXAMPLE 2

Example 1 was repeated except the step using the 70 percent sulfuric acid solution was omitted and also the subsequent deionized water rinse.

EXAMPLE 3

Example 1 was repeated except the cathodic bath of 20 percent sulfuric acid was replaced with a potassium cyanide bath using 8 ounces of potassium cyanide per gallon of deionized water at room temperature and a dwell time of 20 seconds.

EXAMPLE 4

Example 1 was repeated except the concentration of the 70 percent sulfuric acid solution was changed to 40 percent.

EXAMPLE 5

Example 1 was repeated except the anodic bath of 30 percent potassium hydroxide was replaced with an anodic bath of 30 percent sodium hydroxide.

EXAMPLE 6

A continuous strip of beryllium copper having 2 weight percent beryllium and the balance copper was passed through a vapor degreaser. The material was next passed through an anodic bath of 45 percent potassium hydroxide at a temperature of 190° F. A cathode of 304 stainless steel was used and the current density was 190 amperes/foot$^2$. The dwell time in the bath was 20 seconds. The strip was then rinsed in deionized water and passed through a 50 percent sulfuric acid solution at 165° F and a dwell time of 20 seconds. The strip was rinsed again in deionized water and passed through a bath of sodium cyanide using 6 ounces of sodium cyanide per gallon of deionized water. The temperature of the bath was room temperature and the dwell time was 20 seconds. The strip was rinsed in deionized water and then plated in any conventional manner with any number of possible metals and alloys such as nickel, copper or gold yielding the desired uniform void-free plated surface.

EXAMPLE 7

Example 6 was repeated except sodium hydroxide was used in place of potassium hydroxide in the anodic bath.

EXAMPLE 8

Example 6 was repeated except the current density was 100 amperes/foot$^2$ instead of 190 amperes/foot$^2$ in the anodic bath.

In view of the above, it will be seen that the several objects of the invention are achieved and other advantageous results attained.

As various changes could be made in the above methods without departing from the scope of the invention, it is intended that all matter contained in the above description shall be interpreted as illustrative and not in a limiting sense. For example, the treatment could be performed on a beryllium copper strip which is to be part of a metallurgically bonded composite to provide a good bonding surface or prior to a temper heat treatment to improve subsequent electroplating quality.

We claim:

1. A process for surface treatment of beryllium copper material prior to electroplating comprising the steps of:

degreasing the material to remove any organic substances;

passing the material through an anodic alkaline solution to form beryllium compounds of the beryllium in the beryllium copper both on the surface and just below the surface of the beryllium copper; and passing the material through a concentrated sulfuric acid bath to dissolve the formed beryllium compounds thereby providing for a copper-rich surface skin.

2. A process as set forth in claim 1 further comprising a final step of passing the material through a copper surface activating bath.

3. A process as set forth in claim 1 wherein the alkaline solution is a potassium hydroxide solution with a concentration between 10 and 50 percent.

4. A process set forth in claim 3 wherein the concentration of the sulfuric acid bath is above 20 percent.

5. A process as set forth in claim 4 further comprising a final step of passing the material through a copper surface activating bath.

6. A continuous strip process for treatment of beryllium copper material prior to electroplating comprising the steps of:

degreasing the material to remove any organic substances;

passing the material through an anodic alkaline solution to form beryllium compounds of the beryllium in the beryllium copper both on the surface and just below the surface of the beryllium copper;

passing the material through a concentrated sulfuric acid bath to dissolve the formed beryllium compounds thereby providing for a copper-rich surface skin; and passing the material through a copper surface activating bath.

7. A continuous strip process as set forth in claim 6 wherein the alkaline solution is a potassium hydroxide solution with a concentration between 30 and 40 percent.

8. A process set forth in claim 7 wherein the concentration of the sulfuric acid bath is above 50 percent.

9. A continuous strip process for treatment of beryllium copper material prior to electroplating comprising the steps of:

degreasing the material to remove any organic substances;

passing the material through an anodic alkaline solution to form beryllium compounds of the beryllium in the beryllium copper both on the surface and just below the surface of the beryllium copper; and passing the material through a cathodic concentrated sulfuric acid bath to dissolve the formed beryllium compounds thereby providing for a copper-rich surface skin and activating the surface for electroplating.

10. A process for electroplating beryllium copper material comprising the steps of:

degreasing the material to remove any organic substances;

passing the material through an anodic alkaline solution to form beryllium compounds of the beryllium in the beryllium copper on the surface and just below the surface of the beryllium copper;

passing the material through a concentrated sulfuric acid bath to dissolve the formed beryllium compounds thereby providing for a copper-rich surface skin;

passing the material through a copper surface activating bath; and electroplating the material with a suitable plating material.

* * * * *